US005272802A

United States Patent [19]

Stites, III

[11] Patent Number: 5,272,802

[45] Date of Patent: Dec. 28, 1993

[54] METHOD FOR CONSTRUCTION OF A GOLF CLUB

[75] Inventor: John T. Stites, III, Fort Worth, Tex.

[73] Assignee: Head Sports, Inc., Fort Worth, Tex.

[21] Appl. No.: 823,194

[22] Filed: Jan. 21, 1992

[51] Int. Cl.[5] ..... B21B 1/46; A63B 53/04

[52] U.S. Cl. ..... 29/527.2; 29/530; 273/167 E

[58] Field of Search ..... 29/527.1, 527.2, 527.3, 29/527.4, 527.5, 530; 273/167 J, 167 F, 167 H, 167 R, 168

[56] References Cited

U.S. PATENT DOCUMENTS

| | | | |
|---|---|---|---|
| 2,908,502 | 10/1959 | Bradstreet et al. | 273/167 J |
| 3,250,536 | 5/1966 | Moser | 273/167 F |
| 3,356,782 | 12/1967 | Whyte | 264/267 |
| 3,556,533 | 1/1971 | Hollis | 273/171 |
| 3,814,437 | 6/1974 | Winquist | 273/167 |
| 3,941,390 | 3/1976 | Hussey | 273/169 |
| 3,989,861 | 11/1976 | Raasmussen | 273/167 J X |
| 4,214,754 | 7/1980 | Zebelean | 273/167 |
| 4,313,607 | 2/1982 | Thompson | 273/167 |
| 4,411,936 | 10/1983 | Schrewelius | 427/367 |
| 4,449,707 | 5/1984 | Hayashi et al. | 273/171 |
| 4,534,558 | 8/1985 | Yoneyama | 273/167 J X |
| 4,676,508 | 6/1987 | Dilny | 273/167 J X |
| 4,754,976 | 7/1988 | Pelz | 273/169 |
| 4,999,000 | 3/1991 | Finney | 273/167 |
| 5,029,865 | 7/1991 | Kim | 273/167 J X |
| 5,100,144 | 3/1992 | Okumoto et al. | 273/167 J |

FOREIGN PATENT DOCUMENTS

| | | | |
|---|---|---|---|
| 26929 | 2/1977 | Japan | 273/167 J |
| 88570 | 5/1985 | Japan | 273/167 J |

*Primary Examiner*—Timothy V. Eley

*Attorney, Agent, or Firm*—Finnegan, Henderson, Farabow, Garrett & Dunner

[57] ABSTRACT

A golf club includes a golf club head comprising a striking surface and a body portion extending backward from the striking surface. A first indentation is formed toward the rear of the body portion and behind the left most impact point on the striking surface, while a second indentation is formed toward the rear of the body portion and behind the right most impact point on the striking surface. A first weighted element is affixed inside the first indentation, and a second weighted element is affixed inside the second indentation.

16 Claims, 2 Drawing Sheets

METHOD FOR CONSTRUCTION OF A GOLF CLUB

BACKGROUND OF THE INVENTION

The present invention relates to a golf club, and more particularly to a golf club having a head with selectively placed weighting elements, and the method for applying such weighting elements.

The ideal swing of a golf club results in the striking face of the golf club head meeting the golf ball at the center of mass of the golf club head. This location on the golf club head is known in golfing parlance as the "sweet-spot". Striking the golf ball at a location away from the center creates a turning force which tends to rotate or twist the golf club head. This rotation imparts side spin on the ball which causes irregular ball flight. This rotation also reduces the energy transferred to the golf ball, and may negatively influence the intended direction and length of flight or roll.

Many efforts have been made to improve the performance characteristics of a golf club when striking a golf ball away from the center or off-center. A very well known method involves increasing the moment of inertia of the golf club head. The moment of inertia corresponds to or indicates the resistance a system offers to a force which is acting on it in order to set it in motion. The moment of inertia is a function of the mass of each individual particle in a system multiplied by the distance squared between the particular particle and a selected axis through the system. For a golf club head, the relevant axis is drawn through the center of mass of the golf club head.

U.S. Pat. No. 3,941,390 to Hussey teaches adding weighting elements along the outer perimeter of the golf club head in order to maximize the distance between this added mass and the relevant axis. This arrangement tends to improve off-center hits of a golf club such that there is less rotation of the golf club head than would otherwise occur. These added weighting elements, however, by being placed on the outer perimeter of the golf club head do not lie behind the striking face of the golf club head.

The prior art teaches a variety of methods for affixing weighting elements to golf club heads. U.S. Pat. No. 3,356,782 to Whyte teaches pouring a hardenable liquid into a pre-formed cavity in a golf club head. U.S. Pat. No. 3,556,533 teaches using fastening screws of different weights for attaching a sole plate to the bottom portion of a golf club head. U.S. Pat. No. 3,941,390 to Hussey teaches attaching weighting materials by either screws, an adhesive, or by dovetailing the weighting material into a formed cutout. Each of these methods of affixing the weighting materials have several drawbacks. These methods are time consuming, clumsy and subject to failure over the course of time.

Accordingly, it is an object of the present invention to provide a golf club in which the negative effects of off-center strikes is minimized.

Another object is to provide a golf club head with an increased moment of inertia.

Another object is to provide a golf club head with an increased moment of inertia through the addition of weighting elements toward the rear or trailing edge of the golf club head, and located behind the outer limit of possible off-center toe and heel hits.

Another object is to provide a golf club head with an increased moment of inertia through the addition of weighting elements toward the rear or trailing edge of the golf club head, and located behind the outer limit of possible off-center toe and heel hits, and such that the center of gravity of the golf club head is moved toward the rear or trailing edge of the club.

Another object is to provide a method for more easily and more securely affixing weighting elements to a golf club head.

Another object is to provide a method for more easily and more securely affixing weighting elements to a golf club head by spraying the weighting elements into indentations in the golf club head.

SUMMARY OF THE INVENTION

It has now been found that the above and related objects of the present invention are obtained in a golf club having a golf club head comprising a striking surface and a body portion extending backward from the striking surface. A first indentation is formed toward the rear of the body portion and behind the left most impact point on the striking surface, while a second indentation is formed toward the rear of the body portion and behind the right most impact point on the striking surface. A first weighted element is affixed inside the first indentation, and a second weighted element is affixed inside the second indentation.

It has also been found that the above and related objects of the present invention are obtained through a method of affixing a material to a golf club head, the steps comprising forming the golf club head with an outer surface having an indentation, spraying the material into the indentation, allowing the material to solidify, and then removing a portion of the material.

BRIEF DESCRIPTION OF THE DRAWING

The above brief description as well as further objects and features of the present invention, will be more fully understood by reference to the following detailed description of the presently preferred, albeit illustrative, embodiments of the present invention when taken in conjunction with the accompanying drawing.

DETAILED DESCRIPTION OF THE PREFERRED EMBODIMENTS

Figure 1:
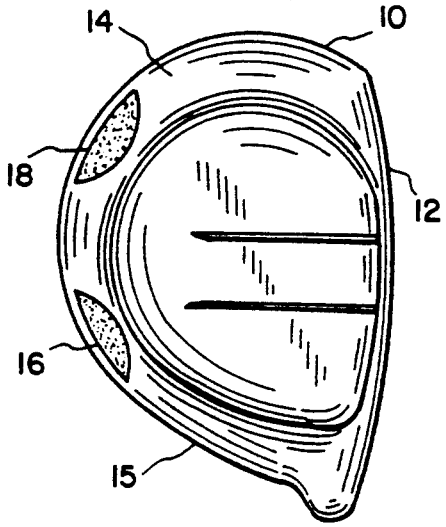
FIG. 1 is a bottom plan view of a golf club head according to the present invention.

Referring now to the drawings, and in particular FIGS. 1–6 thereof, therein illustrated is a golf club head, generally designated by the reference numeral 10, according to the present invention. Golf club head 10 includes a striking surface, generally designated 12, having a body portion 14. The body portion 14 has a first indentation 16 and a second indentation 18 formed on outer surface 15 toward the rear of body portion 14.

Golf club head 10 may be formed of any of the conventional materials used for golf club heads—e.g. steel, investment cast iron, wood, forged metal, graphite, ceramic, etc. Golf club head 10 as depicted in FIGS. 1–6 is hollow. This is not a necessary element to the invention. However, this is a preferred configuration in that the mass is concentrated at the outer edges in order to increase the moment of inertia.

First indentation 16 and second indentation 18 are located on opposite sides of axis X—X passing through the center of mass of golf club head 10. First indentation 16 and second indentation 18 may be formed in golf club head 10 during the original manufacture of golf club head 10, or may be formed after the manufacture of golf club head 10 by removing some portion of outer surface 15 via well known conventional means. The particular shape cf first indentation 16 and second indentation 18 is not of critical importance. The configuration shown in the drawing is merely exemplary.

Figure 2:
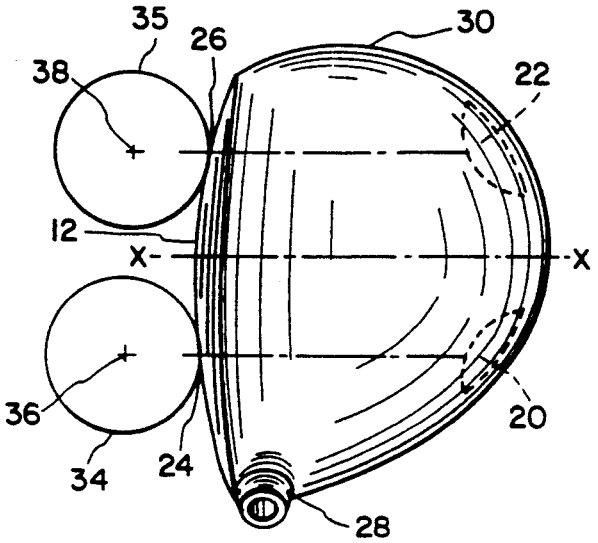
FIG. 2 is a top plan view thereof.
Figure 7:
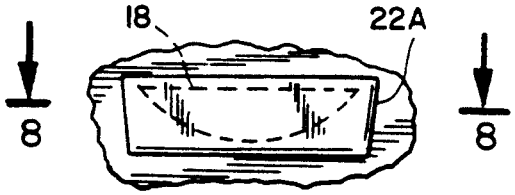
FIG. 7 is a partial side view thereof showing the weighting element in a rough state.
Figure 8:
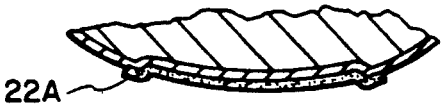
FIG. 8 is a sectional view taken on line 8—8 of FIG. 7.

Referring to FIG. 2, first indentation 16 is located generally behind left most impact point 24 on striking face 12. Second indentation 18 is generally located behind right most impact point 26 on striking face 12. Left most impact point 24 corresponds to the point on striking face 12 most distant from axis X—X at which golf ball 34 may be struck without some portion of golf ball 34 extending beyond side edge 28, and directly behind center 36 of struck golf ball 34. Right most impact point 26 corresponds to the point on striking face 12 most distant from axis X—X at which golf ball 35 may be struck without some portion of golf ball 35 extending beyond side edge 30, and directly behind center 38 of struck golf ball 35.

Weighting element 20 is affixed to and may generally conform to the shape of first indentation 16. Weighting element 22 is affixed to and may generally conform to the shape of second indentation 18. The location of weighting element 20 near side edge 28, and weighting element 22 near side edge 30 allows for the proper balancing of golf club head 10. To properly balance golf club head 10, it is necessary to locate approximately 50% of the total mass of the golf club including golf club head 10 on either side of a plane perpendicular to and passing through the center of striking face 14. The mass of weighting elements 20, 22 may be selected in order to assure this proper mass distribution. Thus, the resulting mass of weighting elements 20, 22 may differ from one another.

The addition of weighting elements 20, 22 to golf club head 10 results in an increased mass directly behind off-center hits striking left most impact point 24 and right most impact point 26. This results in greater energy transfer to any golf ball struck at or near impact points 24, 26 resulting in longer flight or roll distances and greater accuracy. Additionally, the location of weighting elements 20, 22 away from axis X—X results in a greater moment of inertia than would otherwise exist. This greater moment of inertia increases the ability of golf club head 10 to resist the turning force which tends to rotate or twist a golf club head being struck off-center.

The location of weighting elements 20, 22 also results in the center of gravity of golf club head 10 being moved to the rear or trailing edge of body portion 14. This results in the center of mass and correspondingly the center of gravity being moved toward the rear or trailing edge of body portion 14. This movement of the center of gravity results in a higher trajectory of flight for any struck golf ball, and makes it easier for a golfer to strike the golf ball.

The utilization of weighting elements 20, 22 in the manner heretofore described is possible with a golf club head of any configuration. Golf club head 10 as depicted in FIGS. 1–8 is larger than a standard golf club head. The mass of golf club head 10 has been moved to the perimeter and generally located at a distance further from the center of mass than would be the case on a standard golf club head. By moving the mass this further distance, the moment of inertia of golf club head 10 is increased over that of a standard golf club head. The increased moment of inertia results in the benefits already described herein. Golf club head 10 is about 3.625 inches in length, as measured from striking face 12 to the trailing edge of body portion 14. Golf club head 10 is about 1.800 inches in length, as measured from the top to bottom of body portion 14. This extended length results in striking face 12 having a surface area approximately 22% larger than the surface area of the striking face of a standard golf club head. This oversizing also results in golf club head 10 having approximately a 20% greater volume than a standard golf club head.

The oversizing of golf club head 10 requires that the roll and bulge of striking face 12 be flatter than on a standard club. This determination was made through extensive testing conducted on a standard mechanical golfer machine programmed to provide consistent identical swings for each strike of a golf ball. The swing dynamics were modeled, as is standard in the industry, after the swing of Byron Nelson. This is sometimes referred to in the industry as the Iron Byron test. The face roll and face buldge, as these terms are generally known in the golfing art, on golf club head 10 have radii of 14 inches.

Weighting elements 20, 22 may be affixed by any of the conventional means. For example, they may be attached by means of an adhesive or screw. However, the preferred method of affixing weighting elements 20, 22 is by spraying the material comprising weighting elements 20, 22 into first indentation 16 and second indentation 18, respectively. The use of the spraying method, however, limits the materials from which golf club head 10 may be formed to those capable of withstanding high temperatures. Thus, the materials for forming golf club head 10 would preferably be steel, investment cast iron and forged metal. Suitable spraying techniques include metallizing, spray and fuse, rod weld and thermal spraying. The preferred method of spraying is by thermal spraying. The five different types of thermal spraying are generally known in the field as powder combustion, wire(rod) combustion, twin-wire arc, plasma arc, and high velocity oxygen/fuel.

The thermal spraying process involves spraying a properly prepared substrate with any of a variety of materials, which materials have been heated to the molten or semi-molten state and then propelled at sufficient velocity against the prepared substrate to produce a bond. Typical coating materials used in this process include ceramics, carbides, plastics and metals available in powder, wire, or rod form. The heat utilized in a thermal spray process is either provided by oxygen/fuel combinations or a DC electric arc. Flame temperatures from 3,090° centigrade to 16,650° centigrade are typical of the process. The temperature of the substrate, however, never approaches this range. The procedures for applying a thermal spray to a substrate are well known in the industry.

The preferred method of thermal spraying is to plasma arc spray. This method of thermal spraying uses an electric arc process permitting an extremely high temperature. The application equipment generally consists of an electric generator and a feeder machine to force powdered metal through an electric arc in which they are melted and propelled at extremely high velocities against a substrate. The resulting mechanical bond between the substrate and applied material is very strong. This method of spraying is well known. For example, U.S. Pat. No. 3,588,433 to Bailey, et al. is entitled "Arcing Contact Structure And Method Of Making Same" and teaches the general technology relating to plasma arc spraying.

The preferred composition of the material to be sprayed is bronze and aluminum either individually or in some combination. An aluminum bronze composition has been found to yield very good results. The sprayed material generally will have a density about 4% greater than that of the golf club head material.

Figure 9:
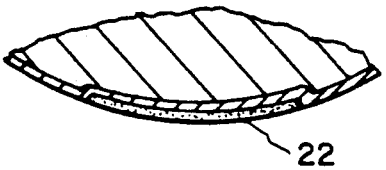
FIG. 9 is a sectional view similar to FIG. 8 but showing the weighting element in a finished state.
Figure 3:
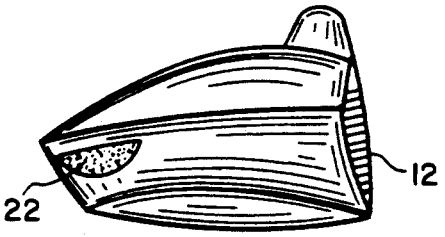
FIGS. 3 and 4 are side views thereof.
Figure 5:
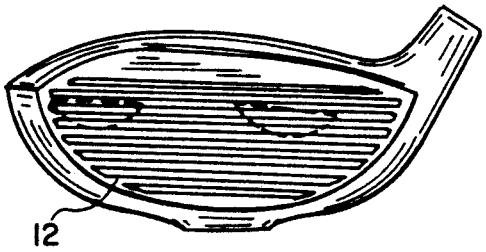
FIG. 5 is a front elevational view thereof.
Figure 4:
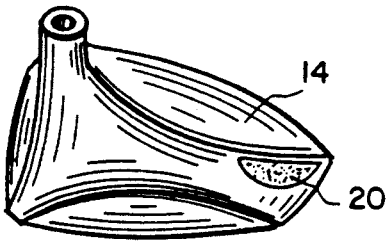
Figure 6:
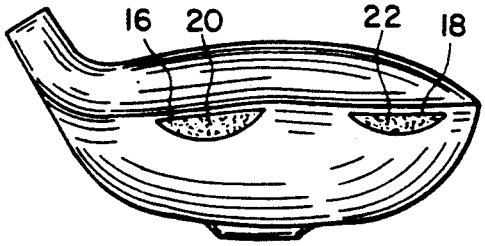
FIG. 6 is a back elevational view thereof.

In addition to the thermal spray process itself, the preferred embodiment of the invention involves certain steps preparatory to the actual spraying. First indentation 16 and second indentation 18 are first cleaned by sand blasting, and then subjected to air blasting to clean away any remaining residue. A mask is then placed around golf club head 10. The mask covers golf club head 10, except that there are two openings which allow access to first indentation 16 and second indentation 18. The openings are approximately ⅛ inch wider in circumference than indentations 16, 18. The spraying process is then carried out. In order to avoid the creation of air pockets within weighting elements 20, 22 and to thereby assure a strong bond, the spraying process is conducted from the same general direction from which the sand blasting process was carried out. Following the spraying of weighting materials 20, 22, they are allowed to cool and solidify. The result is a hardened weighting material, such as weighting material 22A in FIG. 7. A sectional view through weighted material 22A shown is provided in FIG. 8. If desired, a portion of the applied material may be removed to achieve the proper addition of mass, possibly such that the remaining material is flush with the outer surface of the golf club head. For example, weighting element 22A may be ground or otherwise finished such that it is flush with outer surface 15 of body portion 14. This is shown in FIG. 9 where weighting element 22 is now shown flush with outer surface 15. If the mass of weighting element 22A were correct immediately after the spraying, then it would not be necessary to remove any portion of the material.

Figure 10:
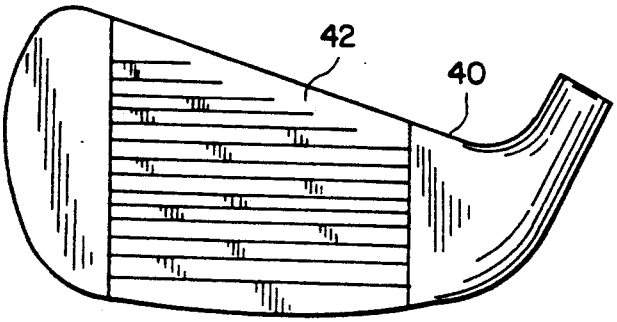
FIG. 10 is a front elevational view of another golf club head according to the present invention.

The method for applying the weighting material is not limited to application to the golf club head structure of golf club head 10. The method may be utilized to apply a material in any shape or form or amount to a golf club head. Referring to FIG. 10, golf club head 40 has front striking face 42. Front striking face 42 is shown following application by the thermal spray process and following solidification and cooling, and following removal of some portion of the material in order to create a finished surface. A satisfactory bond may be attained between golf club head 40 and striking face 42 without the need for spraying the material into an indentation formed in golf club head 40. The applied material of striking face 42 may be directly sprayed onto and bonded to any surface of golf club head 40, or for that matter any part of a golf club.

Of course, if desired, indentations can be formed at any point on a golf club or golf club head. For example, a channel could be formed completely around the perimeter of striking face 14 of golf club head 10 to more easily allow the application of weighting material through the spraying process at the perimeter.

Now that the preferred embodiments of the present invention have been shown and described in detail, various modifications and improvements thereon will become readily apparent to those skilled in the art. Accordingly, the spirit and scope of the present invention is limited only by the appended claims, and not by the foregoing disclosure.

I claim:

1. A method of affixing material to a golf club head, the steps comprising:

forming said golf club head having a striking surface and a body portion extending backward from said striking surface, said body portion having a heel portion adjacent the club shaft and a toe portion distant from said club shaft;

forming a first indentation on the outer surface of said golf club head toward the rear of said body portion and behind the impact point on said striking surface nearest the toe portion of the club head;

forming a second indentation on the outer surface of said golf club head toward the rear of said body portion and behind the impact point on said striking surface nearest the heel portion of the club head; and affixing said material into said first and second indentations.

2. A method as set forth in claim 1, wherein said material is primarily made of aluminum and bronze.

3. A method as set forth in claim 1, wherein said material is primarily made of brass.

4. A method as set forth in claim 1, wherein said material is primarily made of bronze.

5. A method as set forth in claim 1, further comprising removing a portion of said material after solidifying.

6. The method of claim 1, wherein said material is affixed to spraying said material into said first and second indentations and allowing said material to solidify.

7. A method as set forth in claim 6, wherein said spraying is by thermoplasma spraying.

8. A method as set forth in claim 6, wherein said thermoplasma spraying is by plasma arc spraying.

9. A method as set forth in claim 6, wherein said thermoplasma spraying is by twin-wire arc spraying.

10. A method as set forth in claim 6, wherein said thermoplasma spraying is by high velocity oxygen fuel spraying.

11. A method as set forth in claim 6, wherein said thermoplasma spraying is by powder combustion spraying.

12. A method a set forth in claim 6, wherein said thermoplasma spraying is by wire-rod combustion spraying.

13. A method as set forth in claim 6, wherein said material is primarily made of aluminum and bronze.

14. A method as set forth in claim 6, wherein said material is primarily made of brass.

15. A method as set forth in claim 6, wherein said material is primarily made of bronze.

16. A method as set forth in claim 6, further comprising removing a portion of said material after solidifying.

* * * * *

UNITED STATES PATENT AND TRADEMARK OFFICE

CERTIFICATE OF CORRECTION

PATENT NO. : 5,272,802

DATED : December 28, 1993

INVENTOR(S) : John Thomas Stites, III

It is certified that error appears in the above-identified patent and that said Letters Patent is hereby corrected as shown below:

Claim 6, column 6, line 43, "to" should read --by--.

Claim 12, column 6, line 57, "a" should read --as--.

Signed and Sealed this

Third Day of May, 1994

Bruce Lehman

*Attest:*

BRUCE LEHMAN

*Attesting Officer*

*Commissioner of Patents and Trademarks*